US005387130A

United States Patent [19]

Fedder et al.

[11] Patent Number: 5,387,130

[45] Date of Patent: Feb. 7, 1995

[54] SHIELDED ELECTRICAL CABLE ASSEMBLY WITH SHIELDING BACK SHELL

[75] Inventors: James L. Fedder, Etters; John R. Shuey, Mechanicsburg, both of Pa.

[73] Assignee: The Whitaker Corporation, Wilmington, Del.

[21] Appl. No.: 219,314

[22] Filed: Mar. 29, 1994

[51] Int. Cl.[6] ..... H01R 9/03

[52] U.S. Cl. ..... 439/610; 439/607; 439/701

[58] Field of Search ..... 439/78, 79, 350, 354, 439/357, 540, 607–610, 677, 680, 701, 731

[56] References Cited

U.S. PATENT DOCUMENTS

| | | | |
|---|---|---|---|
| 4,506,949 | 3/1985 | Knop | 350/162.19 |
| 4,602,830 | 7/1986 | Lockard . | |
| 4,605,276 | 8/1986 | Hasircoglu . | |
| 4,773,881 | 9/1988 | Adams, III | 439/681 |
| 4,867,707 | 9/1989 | Widdoes | 439/675 |
| 4,984,992 | 1/1991 | Beamenderfer et al. | 439/108 |
| 5,009,614 | 4/1991 | Fogg et al. | 439/497 |
| 5,090,920 | 2/1992 | Casey | 439/540 |
| 5,312,276 | 5/1994 | Hnatuck et al. | 439/701 X |

*Primary Examiner*—Khiem Nguyen

[57] ABSTRACT

The shielded electrical cable assembly (2') has a forward electrical connector (8') for mating with a header (156A') in a computer cabinet (152'). The connector (8') has terminals (30') crimped to respective leads of a shielded electrical cable (6'). The leads extend through a rear housing (10') to which the forward connector (8') is latched. There project rearwardly from the rear housing (10') strain relief flanges (60') which are moulded to jackets (20') enclosing the leads. A two-part shielding shell (12') is secured about the strain relief flanges (60') and is clinched to the shield (18') of the shielded cable (6'). Latches (80') for latching the cable assembly (2') in an aperture in a shielding plate (150') of the computer cabinet are reversely bent to take up the difference in width between the back shell (12') and the aperture in the shielding plate (150').

20 Claims, 8 Drawing Sheets

SHIELDED ELECTRICAL CABLE ASSEMBLY WITH SHIELDING BACK SHELL

BACKGROUND OF THE INVENTION

This invention relates to a shielded electrical cable assembly, especially for insertion into an aperture in a shielding plate to mate with a header. The invention also relates to a back shield for such an assembly.

U.S. Pat. No. 5,009,614 discloses an electrical cable assembly comprising an insulating housing block, conductive electrical contacts of the housing block being connected to corresponding signal wires of a cable. The housing block is received in an insulating housing which is in turn received in an electrically conductive shielding shell. The contacts project from the housing in which the housing block is received, the housing having a mating face facing outwardly of the conductive shell.

U.S. Pat. No. 4,605,276 discloses a co-axial cable connector comprising a first housing in which electrical terminals connected to respective co-axial cables are received and a second housing receiving the first housing. A cable strain relief member for the cables, has a latch member thereon, the latch member engaging in a latching opening of the second housing when the first housing is received therein, to secure the strain relief member against the cables.

U.S. Pat. No. 4,984,992 discloses a cable connector comprising a housing block and an electrical cable having a signal wire connected to a corresponding signal contact and at least one reference wire connected to a reference conductor extending beside the signal contact. A housing coupled to the housing block receives the signal contact in one of multiple contact positions in the housing and a reference contact received in the housing is connected to the reference conductor.

U.S. Pat. No. 4,506,940 discloses an intercard connector system in which a connector is matable with a circuit board mounted header assembly. A connector has a plurality of terminals each having a first end profiled to engage a conductor and an opposite end profiled to engage a pin terminal of the header assembly.

It is an object of the present invention to provide a shielded electrical cable assembly which is insertable through an aperture in a shielding plate, for example a shielded computer cabinet, to mate with a header therein, the electrical assembly being shielded to the extent that it projects from the shielding plate and having built in lead strain relief means so that the assembly can be un-mated with the header by pulling it away therefrom.

SUMMARY OF THE INVENTION

According to an aspect of the invention, a shielded electrical cable assembly comprises a forward electrical connector having a forward insulative housing with a mating forward face and a rear face. First electrical terminals in the forward housing each have a forward portion for mating with a second terminal, for example in a pin header of a computer back plane, by way of the mating face. Each terminal has a rearward connecting portion connected to a lead of a shielded electrical cable extending from the rear face of the forward housing. A rear insulative housing securable to the forward housing defines a through opening for receiving the leads of the shielded cable therethrough. At least one lead strain relief member projecting rearwardly from the rear insulative housing is capable of being overmoulded to the leads of the shielded cable. The cable assembly further comprises a back shell having first and second back shell parts, which are securable about the strain relief members and the leads. The back shell is clinchable to the shield of the cable. One of the back shell parts may have a rear portion which is insertable beneath the shield of the shielded cable, the other back shell part having rearward ears for clinching over the cable shield and the rear portion of the one back shell part.

With the strain relief members overmoulded to the leads and the back shells assembled to the rear housing and clinched to the cable shield, the shielded cable assembly can be inserted through an aperture in a shielding plate, for example in a shielded computer cabinet, to mate the forward electrical connector with a header beneath the shielding plate, with the greater part of the shield projecting above the shielding plate. Thus those parts of the leads which are contained in the back shell and from which the cable shield will have been stripped, are fully shielded, the remainder of the cable assembly being below the shielding plate and being, therefore, adequately shielded. By virtue of the strain relief members which have been overmoulded to the leads of the shielded cable, the forward electrical connector can be unmated with the header by pulling on the shielded cable, without the risk of the connections between the terminals and the leads being disturbed and the cable may be manipulated to lead it from the computer cabinet when the shielded cable assembly is mated with the header.

Appropriately, the back shell is provided with latches for latching it in the aperture in the shielding plate, the latches being so configured as to engage the edges of the aperture and so prevent external electromagnetic interference (EMI) from penetrating beneath the shielding plate by way of the aperture.

For ease in locating the strain relief members relative to the leads for overmoulding thereto, the rear housing is preferably made in a plurality of parts, for example two or four parts, each part having a planar overmoulded strain relief member projecting rearwardly from the rear housing part.

According to preferred embodiments described herein, the latches project from the forward end of the first back shell part and are reversely bent so that latch arms of the latches lie beside, and in spaced relationship with, the first back shell part, the latch arms being provided with latching ledges projecting outwardly therefrom and thus away from the first back shell part. The rear housing will usually, necessarily, be wider than the assembled back shell so that the aperture in the shielding plate must be commensurately wider. The latches are conductive and serve to fill the clearances between the aperture and the shielding shell.

Preferred embodiments of the present invention will now be described by way of example with reference to the accompanying drawings.

DETAILED DESCRIPTION OF THE PREFERRED EMBODIMENTS

Figures 1, 6:
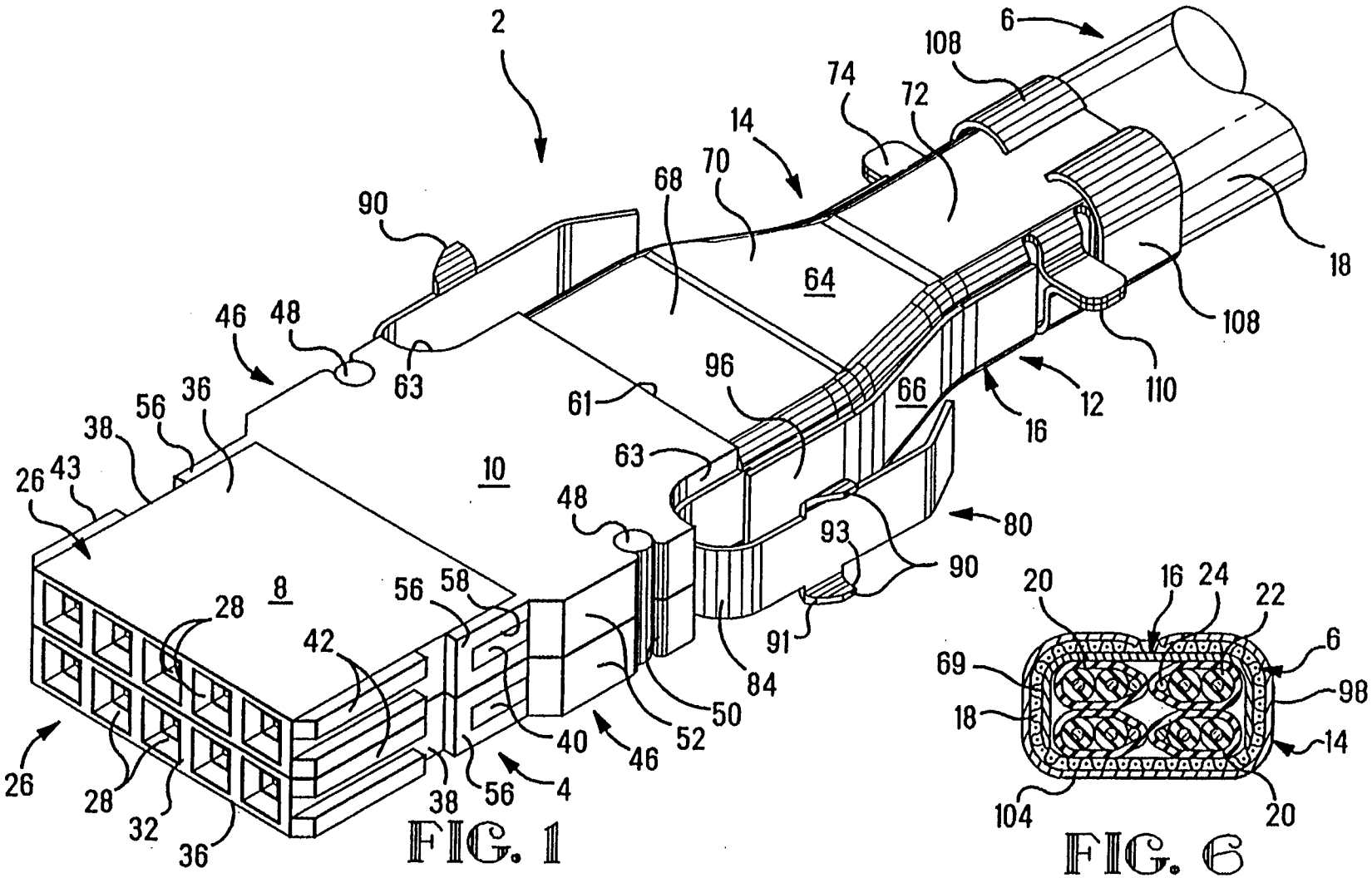
FIG. 1 is an isometric view of a ten position shielded electrical cable assembly according to a first embodiment of the invention, comprising a braid shielded electrical cable terminated to a shielded electrical connector assembly having a back shell clinched to the cable shield.
FIG. 6 is a view taken on the lines 6—6 of FIG. 3.

The first embodiment will now be described with reference to FIGS. 1 to 6. A shielded electrical cable assembly 2 comprises an electrical connector assembly 4 and a braid shielded electrical cable 6, as shown in FIG. 1.

The connector assembly 4 comprises a forward electrical connector 8, a rigid, insulative rear housing block 10 mating with the connector 8, and a two-part EMI shielding back shell 12 comprising an upper back shell part 14 and a lower back shell part 16, each stamped and formed from a single piece of sheet metal stock.

Figure 3:
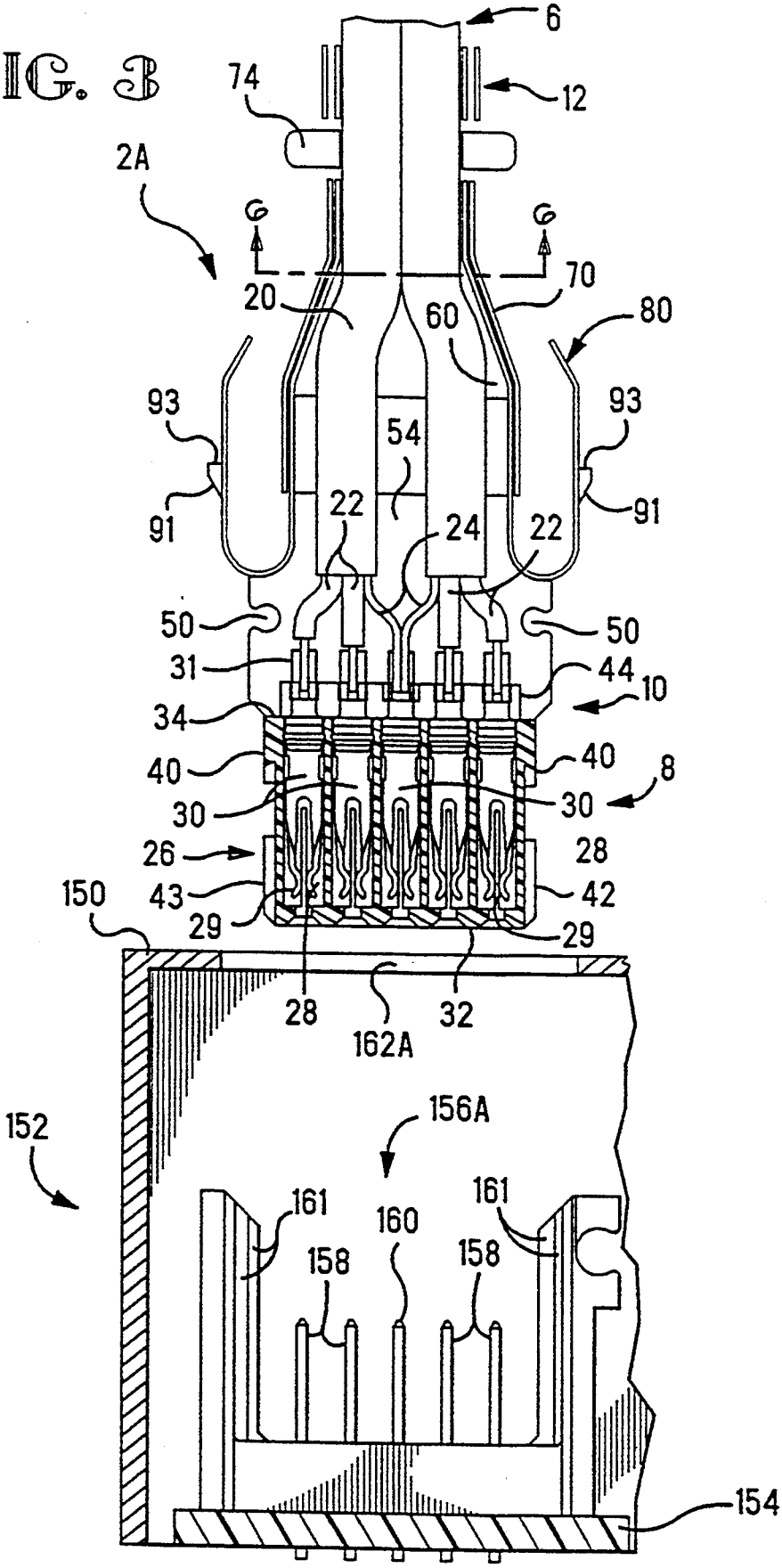
FIG. 3 is a partly diagrammatic, fragmentary, elevational view shown partly in section, of part of a computer cabinet comprising a plurality of pin headers, a first shielded cable assembly according to FIG. 1 being shown prior to being mated with a first pin header.

The cable 6 comprises an outer braid shield 18, which may be of tin plated copper, enclosing two pairs of insulating lead jackets 20 each enclosing two insulated signal leads 22 and a drain wire 24 (see FIGS. 3 and 6). The braid shield 18 extends along the jackets, but a front end of the braid shield 20 is to the rear of the leads 22 that project from the jackets 20.

Figure 2:
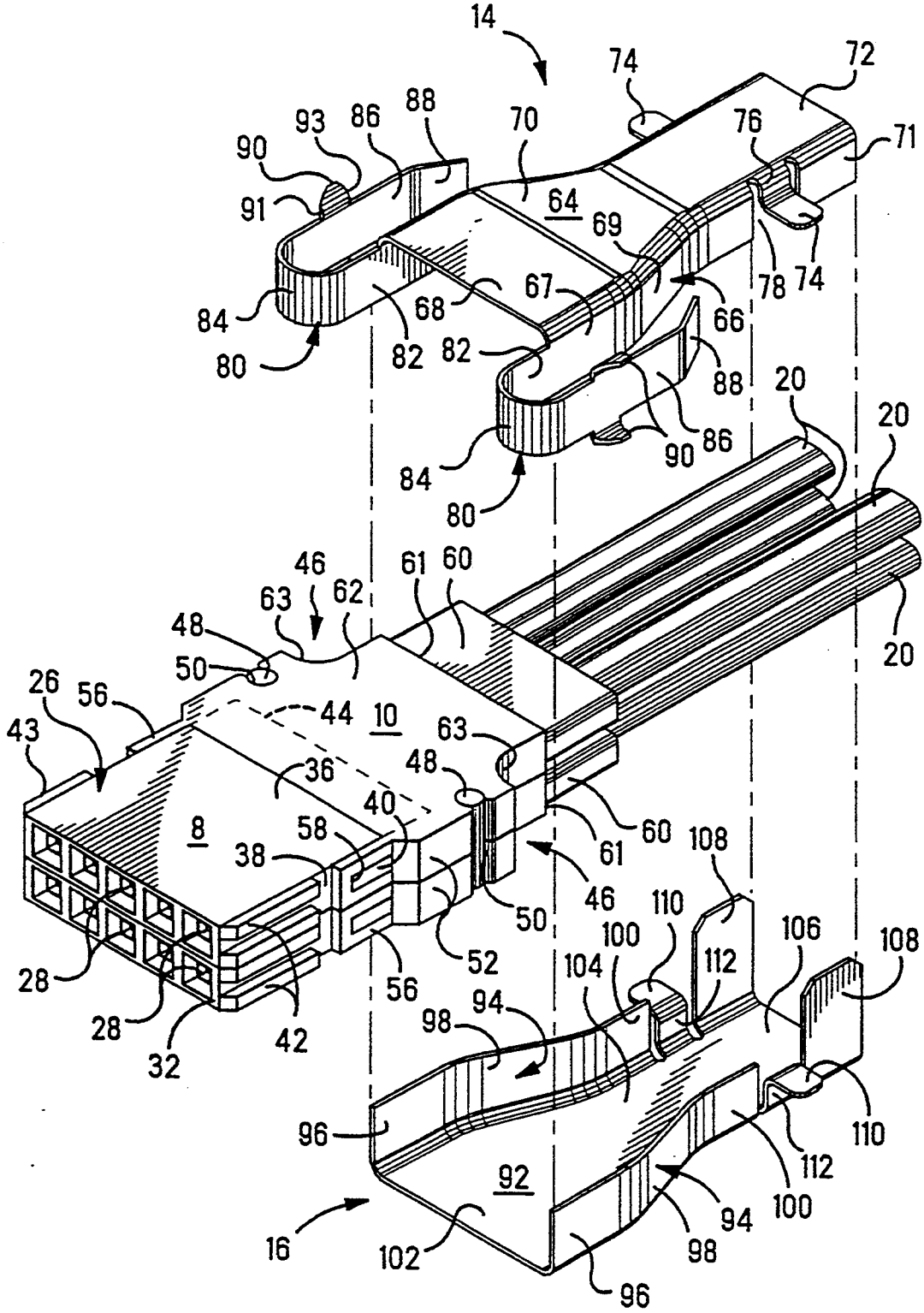
FIG. 2 is an exploded isometric view of the connector assembly applied to the back shell before the shell is clinched to the cable shield.

The forward electrical connector 8, FIGS. 1-3, comprises an insulative forward housing 26 having two superposed rows of five terminal receiving cavities 28 each having secured therein an electrical socket terminal 30 comprising a forward pin socket 29 and a rear welding tab 31. As will be apparent from FIG. 3, the welding tab 31 of the two outer terminals 30 of each row have each been connected to the stripped end of the electrically conductive core of a respective one of the four leads 22, the middle terminal 30 of each row having been connected to the drain wires 24 in two of the jackets 20. Each terminal receiving cavity 28 opens into a mating forward face 32, and a terminal receiving rear face 34, of the housing 26. The housing 26 has opposed upper and lower lateral major faces 36 and opposed lateral minor faces 38. Each minor face 38 has thereon proximate to the terminal receiving face 34, a pair of projecting upper and lower latch members 40. Multiple ribs 42 and 43 project from the minor faces 38, and extend from the mating face rearwardly. There projects rearwardly from the terminal receiving face 34, on each side of the two rows of cavities 28, and parallel with the major faces 36, a planar flange 44 supporting the weld tabs 31.

Figure 4:
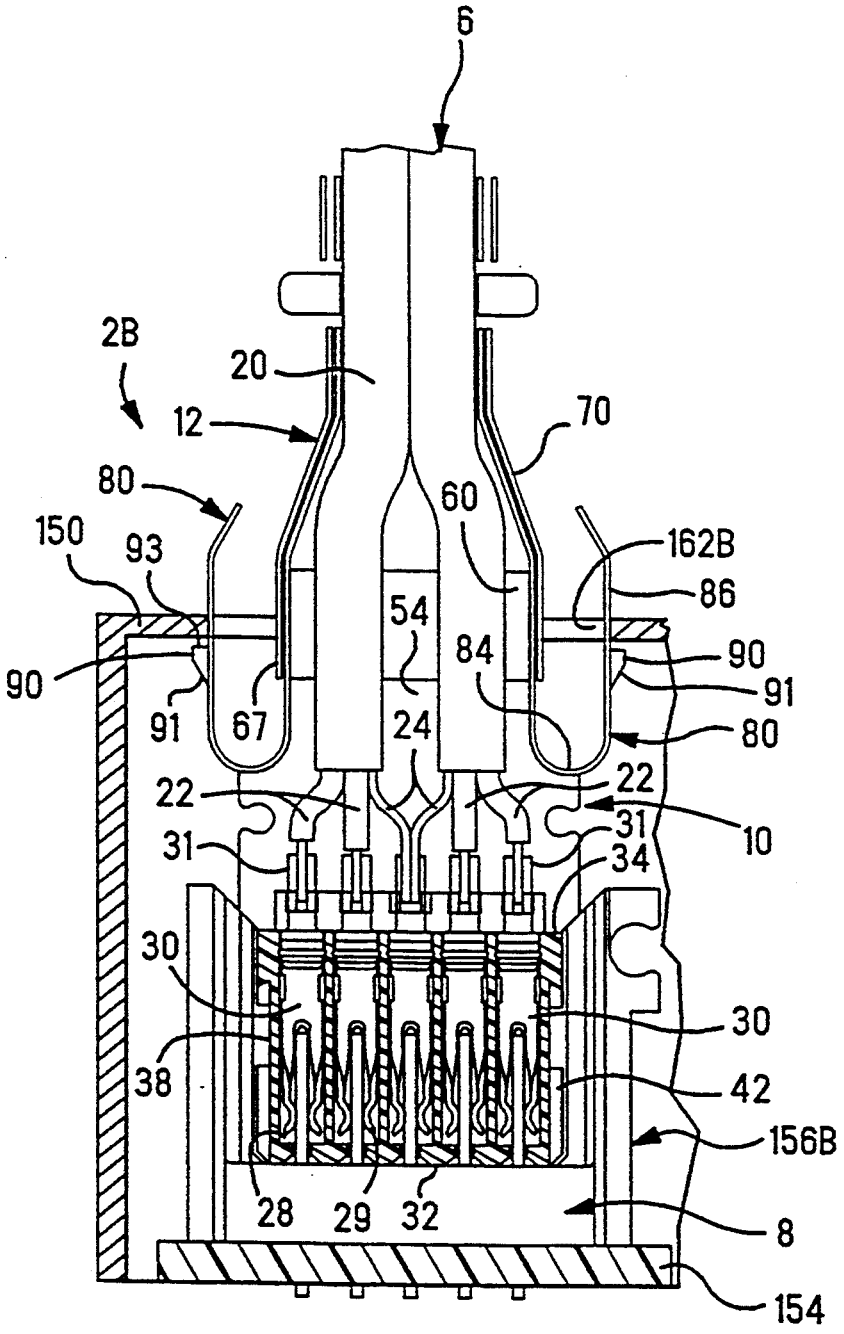
FIG. 4 is a view similar to FIG. 3, showing a second shielded cable assembly according to FIG. 1 being shown when mated with a second pin header.
Figure 5:
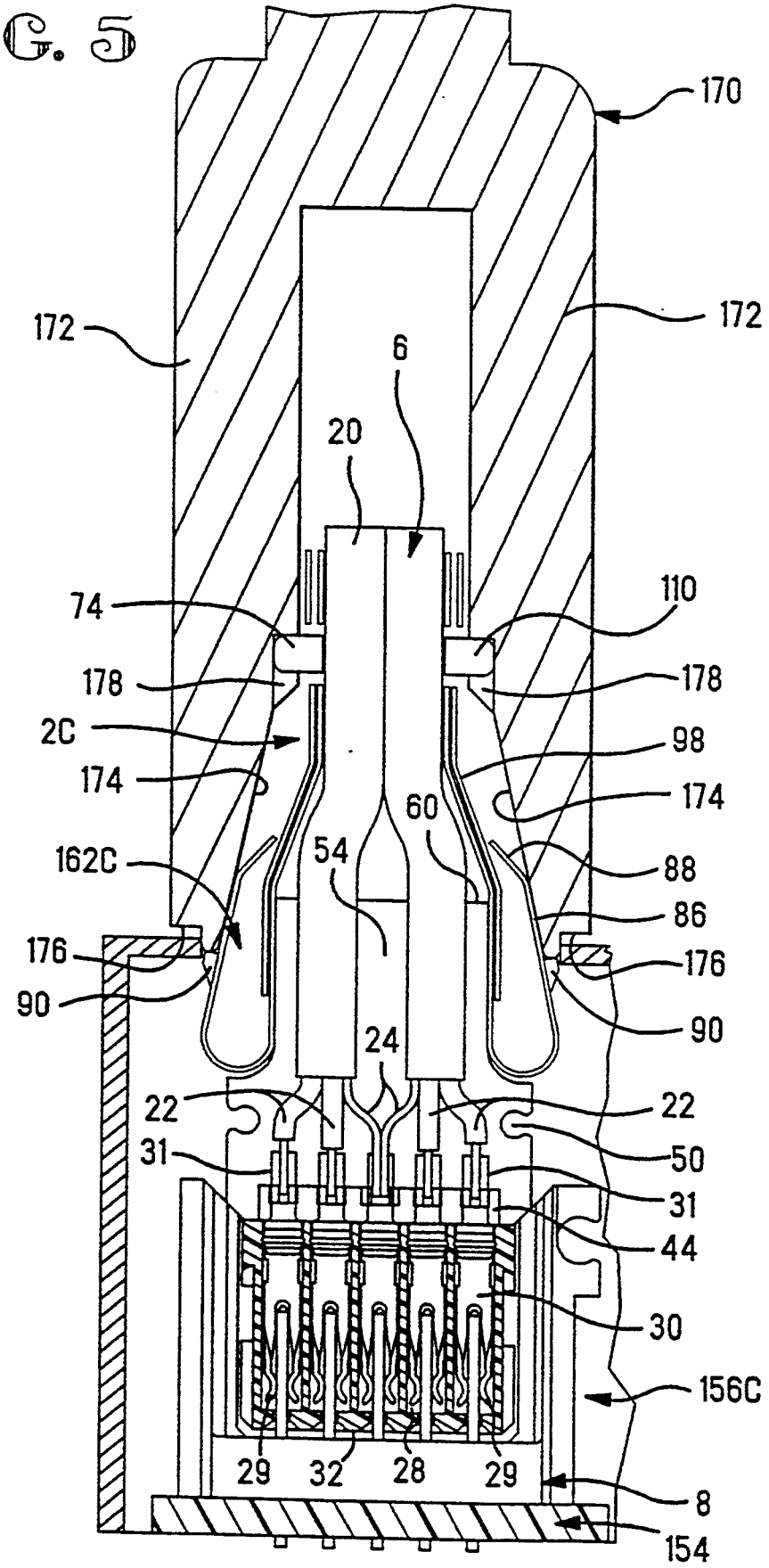
FIG. 5 is a view similar to FIG. 3, showing a third shielded cable assembly according to FIG. 1 being shown when mated with a third pin header and about to be unmated therefrom by means of an extractor tool.
Figures 7, 9:
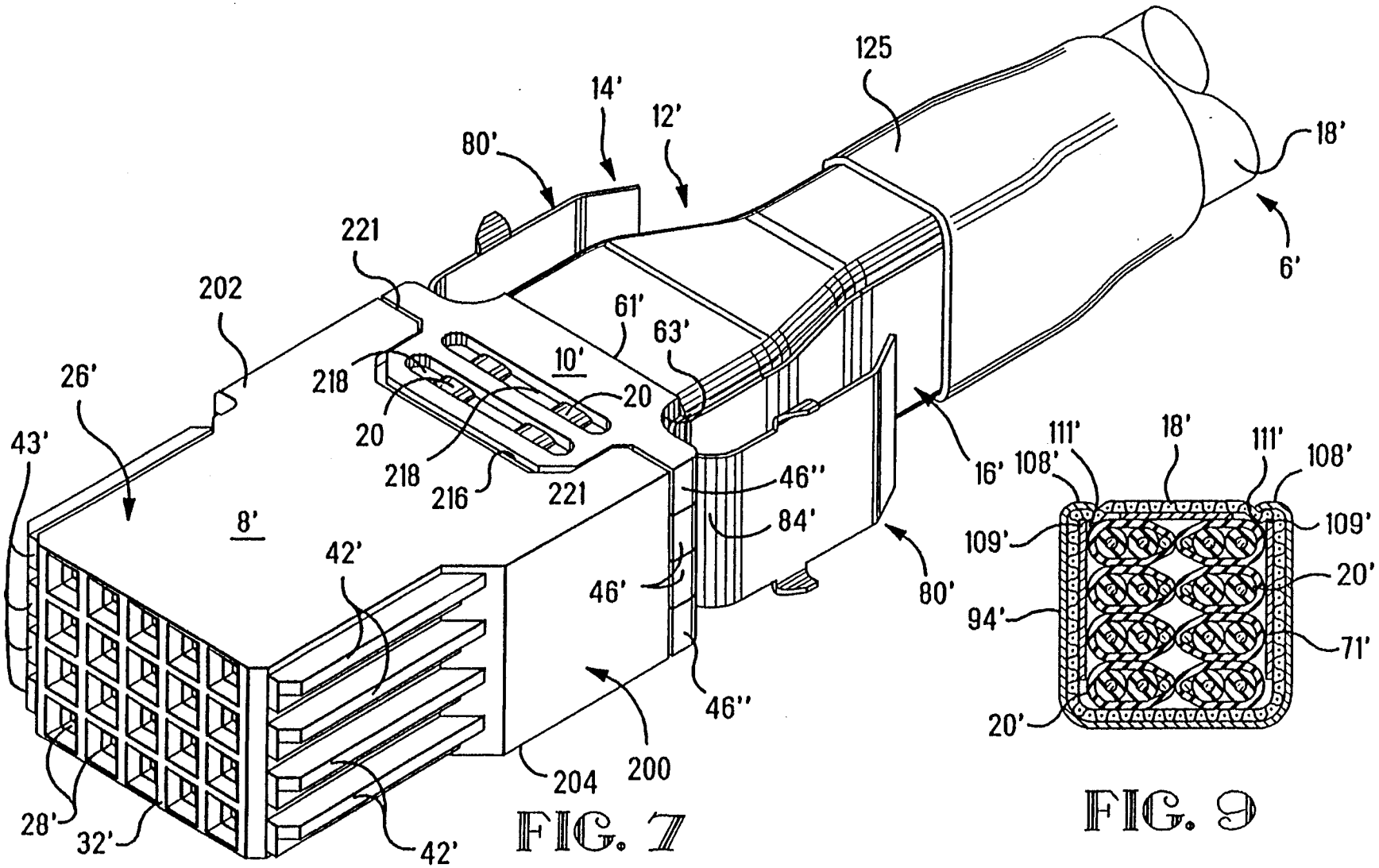
FIG. 7 is a similar view to that of FIG. 1 but showing a second embodiment of a shielded electrical cable assembly, this being a twenty position assembly.
FIG. 9 is a view taken on the lines 9—9 of FIG. 8.

The rear housing block 10 comprises two superposed, identical, overmoulded insulative parts 46, shown in FIGS. 3-5 as being transparent, which are held together by means of dowel pins 48 snugly received in grooves 50 in minor lateral faces 52 of the parts 46. Each rear housing 10 is more particularly described in pending application Ser. No. 08/098,486 filed Jul. 7, 1993 now U.S. Pat. No. 5,346,412. The housing parts 46 intimately surround at 54 the lead jackets 20, the exposed parts of the leads 22 and the drain wires 24, as well as the welding tabs 21. There projects forwardly from each of the minor lateral faces 52, an overmoulded planar latch arm 56 having a latch member receiving opening 58 receiving the latch members 40. A lead jacket strain relief flange 60 projects rearwardly from each of the parts 46 of the housing 10, parallel to a major face 62 thereof. A rearwardly facing shoulder 61 is defined between each part 46 of the housing 10 and the respective flange 60. Forwardly of the grooves 50, the minor faces 52 of the parts 46 are formed with rearwardly facing concave recesses 63.

The upper back shell part 14, FIG. 2, which is elongate and is symmetrical about its longitudinal central plane, is of substantially U-shaped cross-section, comprising a base wall 64 from opposite longitudinal edges of which depend side walls 66, each having a forward side wall section 67, an intermediate side wall section 69 and a rear side wall section 71. The base wall 64 has a forward end portion 68 of substantially the same area as the flanges 60 of the parts 46 of the housing 10. The side wall sections 67 depend from the end portion 68. The base wall 64 further has a rearwardly tapering intermediate portion 70 from which the side wall sections 69 depend, and a rear portion 72 from which the side wall sections 71 depend. The portion 72 is of constant width, corresponding to the overall diameter of the cable 6. There extend laterally outwardly of the end portion 72, substantially centrally of its length, opposite contact lugs 74 connected to the wall portion 72 by way of resilient bights 76 disposed in cutouts 78 in the side wall sections 71. A reversely bent spring latch 80 extends forwardly from the forward end of each side wall section 67 and comprises, as best seen in FIG. 2, a planar root portion 82 coplanar with the respective side wall section 67 and the forward end of which is connected to one end of a spring bight 84. The other end of each bight 84 is connected to a latch arm 86 extending substantially parallel to, and alongside, the respective side wall section 67. Each latch arm 86 terminates in an inwardly bent stress relief tip 88 which is substantially parallel with the side wall section 69. A pair of opposed latching ledges 90 project from opposite edges of each latch arm 86, outwardly of the plane thereof, between the bight 84 and the tip 88. Each latching ledge 90 has a forwardly facing and inclined cam surface 91, and a rearwardly facing latching shoulder 93. The back shell part 16, which is also elongate and of substantially U-shaped cross-section, comprises a base wall generally referenced 92 from opposite edges of which upstand side walls 94, each side wall 94 having a forward side wall section 96, an intermediate side wall section 98 and a rear side wall section 100. The base wall 92 has a constant width forward portion 102, from which the side wall sections 96 upstand, a rearwardly tapered intermediate portion 104, from which the side wall sections 98 upstand, and a constant width rear portion 106 from which the side wall sections 100 upstand. The widths of the base wall portions 102, 104 and 106 slightly exceed the widths of the base wall portions 68, 70 and 72, respectively, of the upper back shell part 14. There upstand from the edges of the base wall portion 106, rearwardly of the side wall sections 100, opposed, planar, clinching ears 108 which project substantially above the side walls 94. Between the side wall sections 100 and the crimping ears 108 there project laterally outwardly of the base portion 106, and beyond the side wall sections 100, opposed contact lugs 110 connected to the edges of the base wall portion 106 by way of resilient bights 112. The back shell parts 14 and 16 may be made of metal or of some other electrically conductive material, for example a metallized synthetic resin.

The manner in which the shielded cable assembly 2 is put together will now be described. The connector 8 is supplied with the bared ends of the cores of the leads 22, and the drain wires 24, welded to the welding tabs 31 of the respective terminals 30 as described above, and with the end portions of the cable jackets 20 of the two pairs separated from each other as best seen in FIG. 3 having been stripped of the braid shield 18. The two overmoulded parts 46 of the rear housing block 10 are separately molded in place with each latch member 40 of the connector 8 received in the overmoulded latch member receiving opening 58 of a respective overmoulded latch arm 56 of the housing 10 and each flange 44 of the connector 8 projecting into the housing 10, as indicated in FIG. 2. The strain relief flanges 60 surround the lead jackets 20 as shown in FIG. 2. The parts 46 of the housing 10 are then secured together by means of the dowel pins 48 which engage in the grooves 50 with a snap action, whereby the parts 46 are fixedly secured together. The overmoulded flanges 60 are over-moulded as one piece with the shell 10 so that the overmoulded housing block 10 constitutes a lead strain relief module. The back shell part 14 is then assembled to the housing block 10 with the forward edge of the base wall portion 68 against the shoulder 61 of the upper one of the parts 46 and with the rearward parts of the base wall portion 72 and the side wall sections 71 beneath the braid shield 18 of the cable 6, as will best be apparent from FIG. 1. The base wall portion 68 then lies on the top of the upper flange 60 and the side wall sections 67 depend beside the flanges 60. The bights 84 of the latches 80 are nested in the complementarily shaped recesses 63 of the housing block 10, as shown in FIG. 1. The rearwardly tapered base wall portion 70 and its side wall sections 69 accommodate the rearward convergence of the separated lead jackets 20 and the unseparated parts of the jackets 20 lie beneath the base wall portion 72 and between its side wall sections 71. The back shell part 16 is now assembled to the housing 10 with the forward edge of the base wall portion 102 against the shoulder 61 of the lower housing part 46. The side wall sections 96, 98 and 100 receive between them the side wall sections 67 and 69 and the rear parts of the side wall sections 71, respectively, of the back shell part 14. The rear end parts of the base wall portion 72 and of the side wall sections 71 of the back shell part 14 are received concentrically with a forward end of the braid shield 18, and between the clinching ears 108 which then project above the cable 6 and the contact lugs 74 and 110 lie in contiguous face to face relationship. When the back shell parts 14 and 16 have been assembled as described above, the ears 108 are clinched down by means of a suitable tool (not shown) to encircle and engage against the braid shield 18 of the cable 6. The assembled back shield 12 is accordingly firmly secured to the cable 6 and the housing block 10, and the contact lugs 74 and 110 are urged against each other against the resilient action of the bights 76 and 112. The back shell parts 14 and 16, are thereby securely coupled in electrically conductive relationship with each other and with the braid shield 18. The stripped lengths of the lead jackets 20 are fully shielded rearwardly of the shoulders 61 of the housing 10.

An example of the commercial use of the shielded cable assembly 2 will now be described with particular reference to FIG. 3, which is to a substantial extent diagrammatic. There is shown in FIG. 3, a portion of an EMI shielded input part of a computer cabinet having a metal chassis 152 on which is a shielded plate 150. Within the cabinet is a back plane comprising a substrate 154 upon which are mounted pin header receptacles 156A, 1565 and 156C, FIGS. 3–5. Each of these receptacles has two rows of pins 158, 160 (one row of which is shown in the receptacle 156A) soldered or press fit without solder to conductors (not shown) on the substrate 154. The center pin 160 of each row is soldered to a ground conductor, with the remaining pins 158 of each row being soldered to respective signal conductors. The housing of each pin header receptacle is formed with internal keyways 161. The shielding plate 150 is formed with through apertures 162A, 162B and 162C aligned with the receptacles 156A, 156B and 156C, respectively.

FIG. 3 shows a first shielded cable assembly 2A located above the shielding plate 150 for insertion through the aperture 162A to mate the connector 8 of the assembly 2A with the pin header receptacle 156A. In the mated condition of the shielded cable assembly, the socket 29 of the central terminal 30 of each row mates with a respective pin 160 to ground the central terminal 30 and the sockets 29 of the remaining terminals 30 of each row mate with respective ones of the pins 158 to connect those terminals to signal current. The insertion of the correct connector 8 into the correct receptacle is ensured if the ribs 42 and 43 of the connector 8 face toward respective keyways 161.

FIG. 4 further shows a second cable assembly 2B when fully mated with the receptacle 156B. It will be apparent from this part of FIG. 4, that during the mating operation, the forward parts of the latches 80 are curved to register easily with and to pass into the aperture 162B of the shielding plate 150, the cam surfaces 91 of the latching ledges 90 engaging the edges of the aperture 162B, and so urging the latch arms 86 towards the respective side wall sections 98 against the action of the spring bights 84 until, the ledges 90 having passed through the aperture 162B, the latch arms 86 are permitted to resile outwardly whereby the shoulders 93 of the ledges 90 overlap the inner face of the shielding plate 150 so that the shielded cable assembly 2B is latched to the plate 150, in a fully mated position. In this fully mated position, the back shell 12 protrudes slightly into the interior of the computer cabinet, which is EMI free, whereby all of the unshielded parts of the cable 6 which lie above the shielding plate 150 are fully shielded. At the same time, by virtue of their reversely bent planar shape, the latches 80 bridge across the space in the aperture between the back shell 12 and the plate 150, and serve to complete the shielding of the interior of the cabinet, afforded by the shielding plate 150 albeit that the aperture of the plate is greatly oversized with respect to the size of the base portions 68 and 102 of the back shell 12, that is to say with respect to the greatest width of the back shell 12 within the latches 80. Said oversize is needed because the housing 10 is substantially wider than the base portions 68 and 102 of the back shell 12, as a result of the presence of the grooves 50 for the dowel pins 48 and the recesses 63 and because the housing 10 is necessarily wider than the connector 8 in order to be capable of receiving it. Since the bights 84 of the latches 80 are lodged in the complementary recesses 63 of the housing 10, the latches 80 are guided through the aperture in the plate 150 without the risk of the bights 84 sustaining damage by stubbing against the plate 150.

Figure 8:
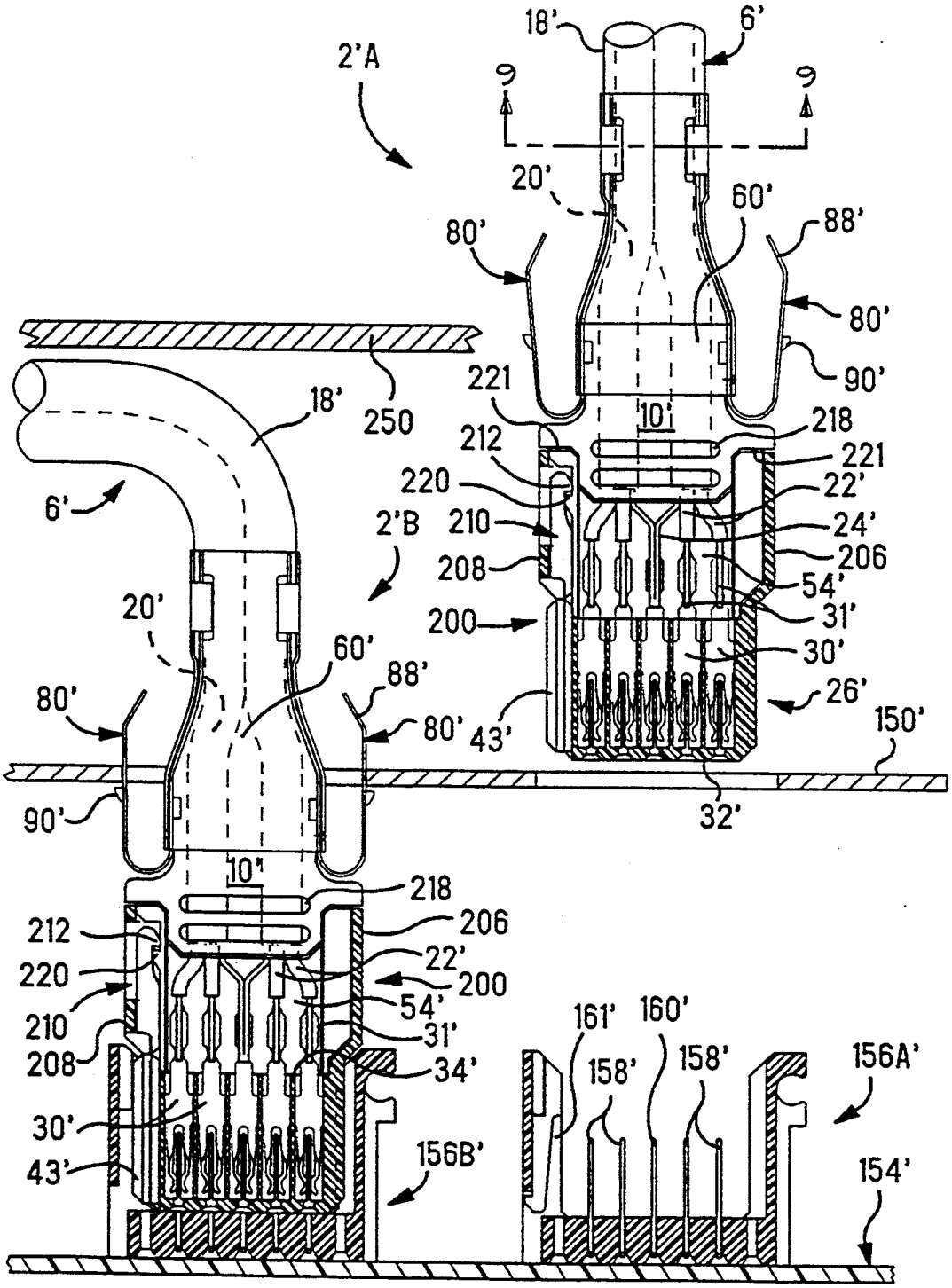
FIG. 8 is a fragmentary view shown partly in section, of part of a further computer cabinet comprising a plurality of pin headers, a first shielded cable assembly according to FIG. 7 being shown prior to mating with a first pin header and a second shielded cable assembly according to FIG. 7 being shown as mated with a second pin header.

FIG. 8 further shows an auxiliary latch 210 and break away key 43' similar to 43. Each latch 210 and break away key 43' is constructed according to the disclosure of application Ser. No. 08/098,486 filed Jul. 27, 1993 now U.S. Pat. No. 5,346,412.

FIG. 5 further shows a third shielded cable assembly 2C in its fully mated position, in association with an extraction tool 170 for the assembly 2C. The tool 170 comprises a yoke having a pair of opposed legs 172 for receiving the upper part of the assembly 2C between them. The legs 172 have inner cam surfaces 174 diverging towards the free ends of the legs 172 and terminating in stop shoulders 176. Above the cam surfaces 174 the legs 172 have grooves 178 into which the lugs 74 and 110 of the back shell parts 14 and 16 can be snap fitted. In order to unmate the shielded cable assembly from the receptacle 156C, the tool 170 is moved down over the cable assembly as shown, so that the cam surfaces 174 engage the latch arms 86 of the latches 80 until the shoulders 176 bottom on the shielding plate 150, the lugs 74 and 110 being received in the grooves 178. The latch arms 86 are thereby forced resiliently inwardly by the cam surfaces 174 so that the latching ledges 90 are moved into alignment with the aperture 162C. The latches 80 having been so released from the shielding plate 150, the tool 70 can be raised to unmate the connector 8 with the receptacle 156C to withdraw it from the computer cabinet. The stress relief tips 88 serve to relieve stress on the latch arms 86 by abutment with the side wall sections 98 of the back shell part 16.

The invention can comprise any number of contact positions. By way of example, a second, twenty position, embodiment of the invention will now be described with particular reference to FIGS. 7 to 10, in which parts having the same function or a similar function to those described above bear the same reference numerals but with the addition of at least one prime symbol. In this embodiment the forward housing 26' of the forward electrical connector 8' of a shielded electrical cable assembly 2' has four rows of five terminal receiving cavities 28' each opening into the mating forward face 32' of the housing 26' and into the rear face 34' thereof and each containing a respective electrical terminal 30'. A shroud 200 projecting from the rear face 34' for receiving the rear insulating housing 10', has three continuous sides 202, 204 and 206 which are extensions of the two major faces 36' and the minor face 38' of the forward housing 26', respectively The remaining side 208 of the shroud 200 comprises a latch arm 210 pivoted to the housing 26' at its forward end and having a latching nose 212.

The rear housing block 10' comprises four superposed, housing parts 46' and 46'' which are held together by the overmoulded insulation material 214. Exposed parts of the cables 20 are housed in openings 218 (two of which are shown) in the upper and lower housing parts 46''. These openings 218 provide clearances for tooling, not shown, that hold the cables 20 in place during an overmoulding operation. Each housing part 46' and 46'' has on one side a latching shoulder 220 with which the latch arm 210 of the forward housing 26' is latchingly engageable. The rearward end of the shroud abuts stabilizing shoulders 221 on the housing parts 46' and 46'' of the rear housing block 10'. There projects rearwardly from each housing part 46' and 46'' a lead jacket strain relief flange 60'. A rearwardly facing back shell stop shoulder 61' is defined between each of the housing parts 46'' and its flange 60'. The housing parts 46' and 46'' cooperate to define a forwardly and rearwardly open cavity 54' through which leads 22' and drain wires 24' of a shielded cable 6', to which leads and drain wires welding tabs 31' of the terminals 30' have been molded to respective wires and, extend rearwardly. The tabs 31' also extend into the cavity. Since there are four rows of terminals 30', each of the flanges 60' of the housing parts 46' extends between two rows of the jackets 20' of the leads and drain wires. The flanges 60' of the housing parts 64'' extend over the top and bottom rows of the jackets 20'. As will be described below each of the flanges 60' has been overmoulded onto the jackets 20' of a respective row. As in the first embodiment each row of jackets 20' comprises two jackets 20'. The housing parts 46' and 46'' cooperate to define concave recesses 63' receiving the bights 84' of the back shell latches 80.

The shielding back shell 12' is similar to the back shell 12 of the first embodiment excepting in the following particulars. The side walls 66' of the upper back shell part 14' and the side walls 94' of the lower back shell part 16' are of twice the height of the corresponding side walls 66 and 94 of back shell parts 14 and 16 of the first embodiment, the latches 80' being of twice the width of the latches 80 of the first embodiment. The contact lugs 74 of the first embodiment are omitted, the side wall sections 71' and 100' being continuous up to the rear ends of the back shell parts 14' and 16', respectively and the clinching ears 108' are substantially shorter than the clinching ears 108 of the back shell part 16 of the first embodiment (FIG. 10).

Figure 10:
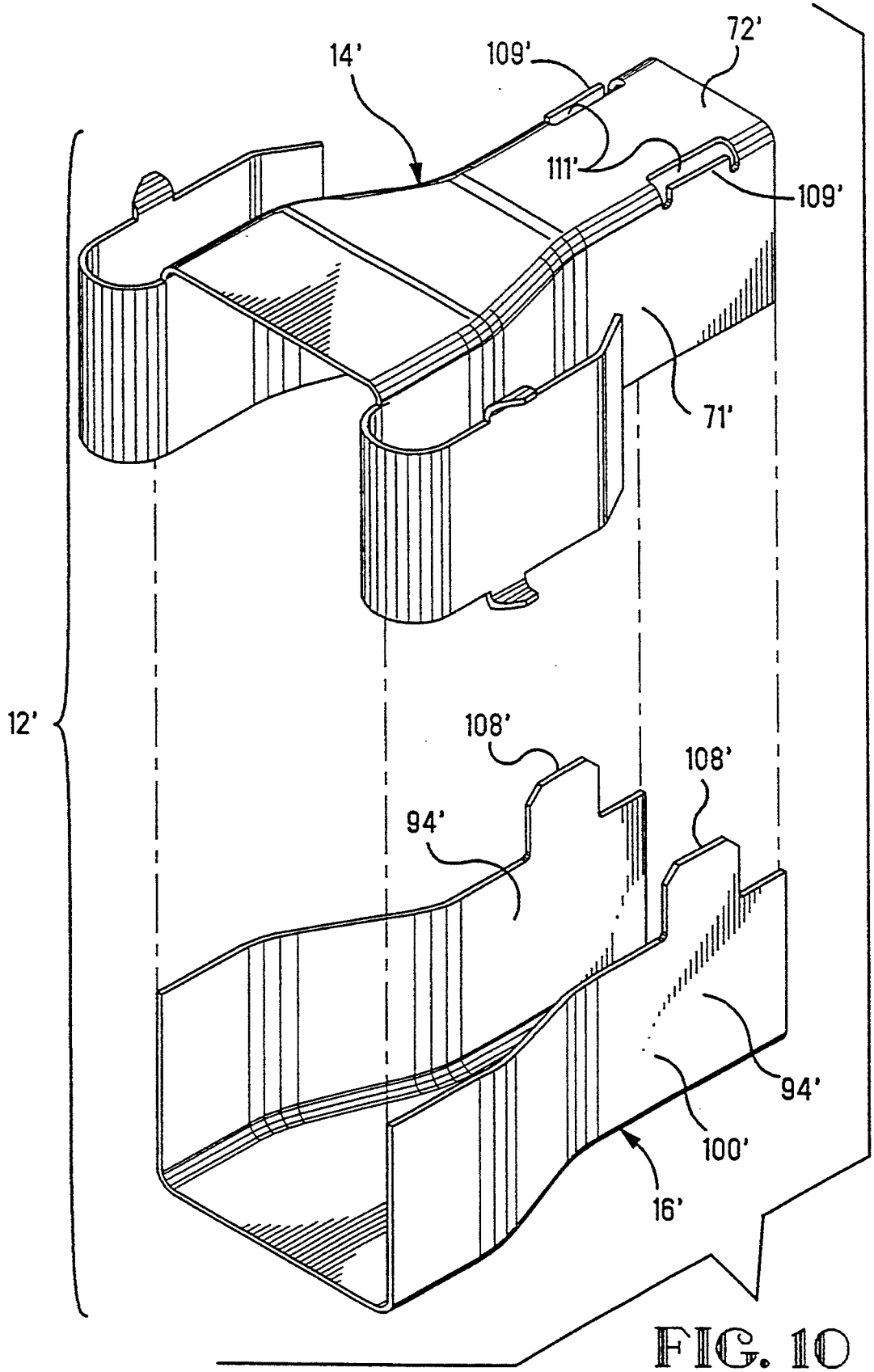
FIG. 10 is a fragmentary exploded isometric view of the rear end portion of a block shell of the assembly of FIGS. 7 to 9.

As in the first embodiment the upper back shell part 14' is received in the lower back shell part 16' with the rear end portion 71', 72' of the upper back shell part 14' beneath the braid shield 18' of the cable 6' and the clinching ears 109' projecting from windows 111' and clinched down against the vertical ears 108' of the shield 18' that project toward and partially into the windows 111' together with portions of the braid as best seen in FIG. 10, whereby the rear portion of the assembly 2' is fully shielded and with electrical contact of the shells and the braid shields 18'. In the present embodiment, a heat shrinkable sleeve 125 (FIG. 5) threaded onto the cable 6' is pulled down so as to cover the clinched connection between the back shell parts and the cable shield 18' and a portion of the back shell parts forward of the clinched connection. The sleeve 125 is then heated securely to grip frayed ends of the braid. The shell 12' itself provide strain relief for the cable 6'.

The housing parts 46' and 46'' are assembled to the forward connector 8' to provide a strain relief module, before the assembly of the back shell parts 14' and 16' to the rear housing 10', as follows.

The flange 60' of one of the housing parts 46'' is inserted laterally between the jackets 20' of the top row and the next adjacent row of jackets 20', the flange 60' of the other housing part 46'' is inserted laterally between the two bottom rows of jackets 20', the flange 60' of one of the two housing parts 46'' is positioned on the jackets 20' of the top row and the flange 60' of the other housing part 46'' is positioned under the jackets 20' of the bottom row of jackets 20'. The housing parts 46' and 46'' are overmoulded together as one piece then latched into the shroud 200 of the forward housing 26' and are secured together to constitute the rear housing block 10' by means of the fasteners 214. The flanges 60' are overmoulded as one piece with the housing parts 46' and 46'', after which the back shell parts 14' and 16' are assembled to the housing block 10'. The ribs 42' provide polarizing keys. The ribs 43' are latches, latching the forward housing 26' to the overmoulded part 46' and break away keys, constructed and assembled as described in U.S. patent application Ser. No. 08/098,486, filed Jul. 27, 1993 now U.S. Pat. No. 5,346,412.

FIG. 8 shows an EMI shielded part of a computer cabinet, which is similar to that shown in FIG. 3 and in which parts corresponding to those of FIG. 3 bear the same reference numerals but with the addition of a prime symbol. The cabinet has a cover 250. As shown in FIG. 6 a first shielded electrical cable assembly 2'A is shown positioned for mating with a twenty position pin header receptacle 156A' with the cover 250 removed. A second shielded electrical cable assembly 2'B is shown mated with a twenty position pin header assembly 156B' with the cover 250 replaced. The cable 6' of the assembly 2'B has been bent down to accommodate the cover 250, thereby resulting in some tensile stress on the cable. The connections between the terminals 30' and the leads 22' and the drain wires 24' are, however, protected by the strain relief means described above. The flanges 60' lie just below the shielding plate 150' for improved shielding of the unshielded jackets 20' containing the leads 22'.

What is claimed is:

1. A shielded electrical connector assembly, comprising;

a forward electrical connector having a forward insulative housing with a mating forward face and a rear face, first electrical terminals in the forward housing each having a forward portion for mating with a mating second terminal by way of the mating face, and a rearward connecting portion connected to a lead of a shielded electrical cable extending from the rear face of the forward housing;

a rear insulative housing block securable to the forward housing and surrounding the leads of the shielded cable, comprising at least one lead strain relief member projecting rearwardly from the rear insulating housing and overmoulded to said leads;

and a back shell having first and second back shell parts which are securable about the strain relief members and the leads, the back shell being clinchable to the shield of the shielded cable.

2. An assembly as claimed in claim 1, further comprising a pair of opposed reversely bent latches on one of the back shell parts, each latch having a root portion projecting forwardly from the one back shell part, a bight connected at one end to a forward end of the root portion, and a latch arm connected to the other end of the bight and extending rearwardly beside the one back shell part and having at least one outwardly projecting latching ledge thereon.

3. An assembly as claimed in claim 2, wherein the rear housing is formed with a pair of opposed, rearwardly facing concave recesses each for receiving the bight of a respective one of the latches.

4. An assembly as claimed in claim 1, wherein the rear housing block comprises a plurality of housing parts, each strain relief member being a planar flange projecting rearwardly from a respective one of the rear housing parts, the rear housing parts being securable together to define said through opening, with the planar flanges in opposed parallel relationship, on opposite sides of rows of the leads of the shielded cable.

5. An assembly as claimed in claim 4, wherein the assembly comprises fasteners, the rear housing parts having through holes for receiving the fasteners to secure the rear housing block parts together.

6. An assembly as claimed in claim 4, wherein each of the rear housing block parts is formed with a groove in each of two opposite sides thereof, the housing parts being arrangeable in superposed relationship with each groove of one housing part in alignment with corresponding groove of the other housing part, the assembly further comprising a pair of pins each of which is insertable into a respective pair of the grooves, when aligned with each other, to secure the rear housing parts in their superposed relationship.

7. An assembly as claimed in claim 1, wherein the forward insulative housing has spaced, parallel flanges projecting rearwardly from the forward housing, the forward housing being securable to the rear insulative housing by means of cooperating latch parts on said housings, said latch members being disposed between the flanges.

8. An assembly as claimed in claim 7, wherein the rear insulative housing block comprises a plurality of parts which are securable together in superposed relationship to define said through opening, each rear housing part having a latching shoulder, the forward insulative housing having a latch arm for latchingly engaging each of said latching shoulders of the rear insulative housing, the forward insulative housing having a shroud for receiving the rear housing.

9. An assembly as claimed in claim 1, wherein each back shell part is of substantially U-shaped cross section having the base wall, and side walls projecting normally from opposite edges of the base wall, the side walls of the first back shell part being receivable between the side walls of the second back shell part, the first back shell part having a rear end portion for insertion beneath the shield of the shielded cable, and the second back shell part having opposed side wall portions projecting beyond the side walls of the first back shell part for clinching to the shield of the shielded cable.

10. A shielded electrical cable assembly for insertion into an aperture in a shielding plate from one side thereof to mate with a header on the other side of the shielding plate, the cable assembly comprising;

a forward electrical connector for reception in the header and having a forward insulative housing with a mating forward face and a rear face, first electrical terminals in the forward housing each having a forward mating portion for mating with a respective second electrical terminal in the header, by way of the mating face, and a rearward connecting portion connected to a respective lead of a shielded electrical cable extending rearwardly from the rear face of the forward housing;

a rear insulative housing block secured to the forward housing and defining a through opening through which unshielded leads of the shielded cable extend, said rear housing block being overmoulded to the unshielded portions of the leads to provide a strain relief module; and a shielding back shell secured about the strain relief members and the leads of the shielded cable, a rearward portion of the shielding back shell being secured to the shielding of the shielded cable whereby the unshielded portions of the leads are shielded by the back shell, there projecting forwardly from the forward edge of the back shell a pair of latches disposed on opposite sides of the back shell, the latches having latch arms that overlie the back shell rearwardly of the forward edge thereof.

11. An assembly as claimed in claim 10, wherein each latch arm has a latching ledge projecting outwardly thereof away from the back shell, the latching ledges being engageable with said other side of the shielding plate with the latch arms engaging opposite edges of the aperture in the shielding plate, and with the forward edge of the back shell positioned on said other side of the shielding plate.

12. An assembly as claimed in claim 10, wherein the back shell comprises first and second back shell parts, the first back shell part being received in the second back shell part and having a rearward portion extending beneath the shield of the shielded cable, the second back shell part having a pair of clinching portions and the shield of the shielded cable being engaged between the clinching portions and the rearward part of the first back shell.

13. An assembly as claimed in claim 10, wherein each latch comprises a root portion projecting from the forward edge of the back shell and a bight extending outwardly of the back shell and connecting the root portion to the latch arm of the latch, the rear insulative housing, having lateral recesses each receiving a respective one of said bights.

14. An assembly as claimed in claim 10, wherein the back shell comprises first and second back shell parts, the first back shell part being received in the second back shell part, each back shell part comprising a base wall from opposite edges of which project side walls normally of the base wall, the base wall of each back shell part having a resiliently mounted contact lug projecting from opposite edges of said base wall, beyond the shielded cable, each contact lug of the first back shell part being resiliently engaged against the respective contact lug of the second back shell part, each latch arm terminating in a strain relief tip for engagement with a respective side wall of the second back shell.

15. An assembly as claimed in claim 10, further comprising a length of heat shrinkable sleeve surrounding said rearward portion of the back shell, and a forward portion of the shielded cable, and being heat shrunk to the rearward portion of the back shell and forward portion of said cable.

16. A back shell for a shielded electrical cable assembly, the back shell comprising;

a first back shell part of substantially U-shaped cross section having a base wall and side walls projecting normally from opposite edges of the base wall, the base wall having a forward portion and a rear portion, a first section of each side wall projecting from said rear portion and a second portion of each side wall projecting from said forward portion, opposed latches each having a root portion extending from the forward edge of a respective one of the first side wall sections, a latch arm extending beside the respective one of the side walls in spaced relationship thereto, and a bight connecting the root portion to the latch arm and the latch being thereby of reversely bent configuration, a latching ledge being provided on each latch arm; and a second back shell part having a base wall and side walls extending normally from opposite edges of the base wall, the base wall having a forward end portion and a rear end portion, a rear end portion of the base wall having a pair of clinching portions upstanding therefrom substantially beyond the side walls of the second back shell part, in the same direction as those side walls, and wherein the side walls of the first back shell part are receivable between the side walls of the second back shell part with the root portions of the latches of the first back shell part projecting forwardly beyond the forward end portion of the base wall of the second back shell part, with the rear portion of the base wall of the first back shell part and the rear sections of the side walls of the first back shell part between the clinching portions of the second back shell part and the clinching portions projecting beyond the rear portion of the base wall of the first back shell part.

17. A back shell as claimed in claim 16, wherein the latching ledge of each latch arm projects outwardly thereof and away from the first back shell part and has a forwardly facing cam surface and a rearwardly facing latching shoulder, the latching ledge projecting from a longitudinal edge of the respective latch arm.

18. A back shell as claimed in claim 16, wherein each latch arm terminates in a strain relief tip which is inclined towards a respective side wall of the first back shell part.

19. A back shell as claimed in claim 16, wherein rearwardly of the rear side wall section of the first back shell part there are connected to opposite edges of the rear portion of the base wall of the first back shell part, respective resilient contact lugs, the second back shell part having a similar pair of contact lugs projecting from opposite edges of the base wall of the second back shell part for face to face engagement with the contact lugs of the first back shell part.

20. A back shell as claimed in claim 16, wherein each back shell part has an intermediate base wall portion which tapers rearwardly of that back shell part.

* * * * *